US010900268B2

(12) United States Patent
Colligan

(10) Patent No.: US 10,900,268 B2
(45) Date of Patent: Jan. 26, 2021

(54) SLIDING DOOR SYSTEM

(71) Applicant: Accurate Lock & Hardware Co. LLC, Stamford, CT (US)

(72) Inventor: Francis Colligan, New Haven, CT (US)

(73) Assignee: Accurate Lock & Hardware Co. LLC, Stamford, CT (US)

( * ) Notice: Subject to any disclaimer, the term of this patent is extended or adjusted under 35 U.S.C. 154(b) by 200 days.

(21) Appl. No.: 16/201,453

(22) Filed: Nov. 27, 2018

(65) Prior Publication Data

US 2019/0162002 A1 May 30, 2019

Related U.S. Application Data

(60) Provisional application No. 62/720,221, filed on Aug. 21, 2018, provisional application No. 62/591,462, filed on Nov. 28, 2017.

(51) Int. Cl.
*E05D 13/00* (2006.01)
*E05D 15/06* (2006.01)
(Continued)

(52) U.S. Cl.
CPC ..... *E05D 15/0647* (2013.01); *E05B 65/0876* (2013.01); *E05C 1/06* (2013.01);
(Continued)

(58) Field of Classification Search
CPC ..... E05D 15/0647; E05D 15/0656; E05D 15/0643; E05D 15/0652; E05D 15/063;
(Continued)

(56) References Cited

U.S. PATENT DOCUMENTS 1,067,678 A * 7/1913 Prim ..... E05D 15/0656 16/93 R
1,251,483 A * 1/1918 Days ..... E05D 15/063 16/97
(Continued)

FOREIGN PATENT DOCUMENTS

WO WO2017068362 A1 4/2017

OTHER PUBLICATIONS

All About Doors & Windows; Sep. 20, 2017; retrieved from: http://www.allaboutdoors.com/Products/Sliding-Door-Tracks/Track-Cover-Patio-Sliding-Glass-door-96-inch-Stainless also see http://www.allaboutdoors.com/Products/Sliding-Door-Tracks/6-Foot-Replacement-Track-for-Sliding-Glass-Door-Aluminum.

*Primary Examiner* — Jerry E Redman
(74) *Attorney, Agent, or Firm* — Forge IP, PLLC

(57) ABSTRACT

A sliding door system with a door includes a horizontally elongated member having a mounting portion with which it is mounted to a support structure, and a horizontally elongated track extending downwardly therefrom. The horizontally elongated track includes a horizontally elongated upper portion having a width, and a horizontally elongated protuberance below the upper portion having a width greater than the width of the upper portion. At least one sliding element is mounted to the top of the door and has a channel corresponding to the protuberance, and in which part of the elongated protuberance is disposed such that the sliding element is retained by and slidable on the protuberance. In some embodiments, a vertically extending rod is concealed between the front and back walls of the door and can be moved vertically in and out of an aperture in the protuberance to lock and unlock the door.

21 Claims, 18 Drawing Sheets

(51) Int. Cl.
*E05F 5/00* (2017.01)
*E06B 3/46* (2006.01)
*E05C 1/06* (2006.01)
*E05B 65/08* (2006.01)

(52) U.S. Cl.
CPC ..... *E05D 15/0656* (2013.01); *E05F 5/003* (2013.01); *E06B 3/4636* (2013.01); *E05Y 2900/132* (2013.01)

(58) Field of Classification Search
CPC ... E05D 13/04; E05B 65/0876; E05B 3/4609; E05B 3/4654; E05C 1/06; E05Y 2900/132
USPC ..... 49/409, 410; 16/96 R, 94 R, 93 R, 88, 16/91, 95 R, 86.1, 87 R, 87.6 R, 87.8, 16/87.2, 97.4 R, 96 D, 93 D
See application file for complete search history.

(56) References Cited

U.S. PATENT DOCUMENTS 1,269,133 A * 6/1918 Townsend ..... E05D 15/0656 16/93 R
2,048,845 A * 7/1936 Danley ..... E05D 15/0643 16/87 R
2,207,322 A * 7/1940 Long ..... E05D 15/063 49/409
2,728,101 A * 12/1955 Cowdroy ..... E05D 15/0643 16/88
3,577,930 A * 5/1971 Rooklyn ..... B65G 17/20 104/173.1
3,727,349 A * 4/1973 Bainbridge ..... E05D 15/06 49/411
3,745,706 A * 7/1973 Stermac ..... E05D 15/066 49/425
3,774,665 A * 11/1973 Bourne ..... A47H 5/06 160/343
4,190,927 A * 3/1980 Hepperle ..... A47H 1/00 16/106
4,272,923 A * 6/1981 Anderson ..... E05F 15/56 49/360
4,424,605 A * 1/1984 Squires ..... E05D 15/0652 16/94 R
4,643,005 A 2/1987 Logas
4,944,169 A 7/1990 Labelle et al.
5,907,890 A * 6/1999 Redaelli ..... E05D 15/0647 16/93 R
6,055,777 A * 5/2000 Rekioja ..... E05F 15/56 49/360
6,131,340 A * 10/2000 Clark ..... B63B 43/24 114/202
6,324,789 B1 * 12/2001 Stephen ..... E05F 15/652 49/362
6,832,449 B2 * 12/2004 Rennetaud ..... F16C 29/02 49/118
6,925,681 B2 * 8/2005 Lin ..... B60J 1/2011 16/87 R
7,201,408 B2 4/2007 Cennamo, Jr.
7,441,726 B2 10/2008 Melberg et al.
7,555,871 B1 * 7/2009 Neal ..... E05D 15/0621 49/409
7,653,966 B2 * 2/2010 Quinn ..... E05D 15/0652 16/96 R
8,112,954 B2 2/2012 Gosling et al.
8,430,436 B2 4/2013 Shilts
8,458,957 B2 6/2013 Guzzi-Nicolia
8,499,496 B2 8/2013 Picchio
8,959,836 B2 2/2015 Gayhart
9,160,220 B2 * 10/2015 Cavalcante ..... H02K 41/02
10,450,796 B2 * 10/2019 Seuberling ..... E05D 15/0643
2016/0258198 A1 9/2016 Bouthillier

* cited by examiner

SLIDING DOOR SYSTEM

FIELD OF THE INVENTION

The present invention relates to sliding doors. More specifically, the invention relates to surface-mounted sliding doors employing a sliding assembly that both avoids derailment problems and has anti-ligature characteristics that make it difficult for ropes, cords, wires, articles of clothing or other pieces of material (hereinafter referred to as "ligatures") to be tied or looped around the door hardware, whether intentionally or unintentionally, to cause harm to persons having access thereto.

BACKGROUND OF THE INVENTION

Sliding doors have been gaining popularity in recent years and provide several benefits over traditional hinged, swing-type doors. In particular, surface-mounted sliding doors are used in a number of different applications.

For example, barn style doors are becoming increasingly popular as interior doors within homes, offices, hotels, and the like. Barn style doors generally hang from multiple wheels (typically from two to four) that ride along a rail mounted above the door opening. In many cases, the bottom of the door is not attached to a track or the like, and thus, the bottom of the door is able to swing outwardly about the top track.

Certain mechanisms may be included to provide some level of protection against the doors slipping off the tracks. For example, the wheels may be provided with a circumference having a convex surface, with the rail being provided with a corresponding curved shape so that rail fits within the convex surface of the wheels, or the rail may be provided with a U-shaped cross-section in which the wheels sit.

Nevertheless, if the door is jarred with enough force, one or more of the wheels may slip off the rail. This may lead to one side of the door contacting the ground, making it difficult, if not impossible, to open or close the door, potentially leading to a person becoming trapped within a room. Even more disadvantageously, if all of the wheels slip off the rail, the entire door may fall, thereby crushing anyone near the door. Given that some doors may weigh upwards of 200 or even 250 pounds, this may cause significant injury, or even death, particularly in the case of small children. Moreover, even for designs that are relatively successful at keeping the wheels from slipping off the rail, the wheel connectors are nevertheless known for frequently jamming or breaking.

Another increasingly popular use of sliding doors is at locations where there is an increased risk that individuals will use a door to harm themselves. In many environments, such as, for example, medical facilities, schools, jails, offices, government buildings, residences, and other institutions, there exists a population of people at risk of trying to injure or kill themselves. In many psychiatric hospitals, for example, patients have been known to attempt suicide, often via hanging, while in the care of the institution.

These suicide attempts are known to have involved the use of doorknobs, hinges, and other door hardware. To attempt suicide, a person may wrap a ligature, such as a belt (or any other type of ligature), around a doorknob or hinge in order to hang himself/herself. Institutions have many private rooms where such a suicide attempt may take place, such as bathrooms. Every private room cannot be watched at the same time without enormous staff resources. Therefore, private rooms, and the door hardware in them, can provide an opportunity for a suicide attempt.

This problem of suicide attempts has been addressed in many institutions by simply removing all door hardware, and sometimes, even the doors themselves. While this may reduce the opportunity for suicide attempts, it also eliminates all privacy and security.

Some current designs for anti-suicide door hardware have included flush-mounting, low profiles, and steep angles to inhibit the affixing of a ligature. However, these known designs fail to fully inhibit the ability of a person to use door hardware for attempting suicide. Furthermore, in an attempt to make the door hardware difficult to use for the purpose of attempting suicide, some known designs have made normal operation of the door hardware difficult. Moreover, current designs are not particularly well-adapted for surface-mounted sliding doors, which present issues not presented by other types of doors.

For example, once such sliding door design that has been suggested to prevent individuals from securing ligatures about parts of the door is the system disclosed in International Patent Application No. WO 2017/068362 by Monaghan. This system suffers from a number of disadvantages. First, it still relies on a sliding system that employs wheels or rollers which, even if they do not fall off the track, are still prone to jamming and/or breaking. Moreover, the assembly is for a pocket door, in which the system is thus able to prevent access to the sliding system (and thereby prevent its use for ligatures) by using a leaf assembly in conjunction with the pocket. This system not only requires multiple, complex parts, but it is also not suited for surface-mounted doors, where there is no pocket to hide an unused portion of track.

There are also systems that use sliding systems that do not depend on the use of wheels, rollers, or the like, such as that disclosed in U.S. Pat. No. 2,207,322 to Long. However, this sort of system does so by forming a track out of the pieces of the header of the doorway itself. This requires both the foresight and expense of specifically constructing the doorway in this manner, and more importantly, likewise requires a pocket door design that does not work for the surface-mounted doors previously described.

In addition to other disadvantages noted above, unlike these and other prior art systems, it would be beneficial if the system could be used in retrofit situations (e.g., where standard wall openings are provided), instead of requiring openings that have been particularly adapted for use with pocket-type doors.

What is desired, therefore, is a system that can be used in retrofit situations (e.g., where standard wall openings are provided), instead of requiring openings that have been particularly adapted for use with pocket-type doors. What is further desired is a surface-mounted sliding door with a sliding assembly that provides enhanced protection against the door becoming partially or fully disengaged from the mounting system, thereby providing enhanced reliability and a lower chance of accidental injury. What is also desired is a surface-mounted sliding door with anti-ligature characteristics.

SUMMARY OF THE INVENTION

In order to overcome the deficiencies of the prior art, the invention comprises a sliding door system, including a door having a top surface, and a horizontally elongated member having a mounting portion with which the elongated member is mounted to a support structure and a horizontally elongated track extending downwardly from the mounting portion. The horizontally elongated track comprises a horizontally elongated upper portion having a width, and a horizontally elongated protuberance below the upper portion having a width greater than the width of the upper portion. The system further includes at least one sliding element mounted to the top surface of the door, the sliding element having a channel corresponding to the protuberance and in which part of the elongated protuberance is disposed such that the sliding element is retained by and slidable on the protuberance.

In some embodiments, the channel has a horizontally elongated opening along the top thereof that accommodates the horizontally elongated upper portion of the track as the sliding element slides on the protuberance. In some of these embodiments, the protuberance comprises a bulge, and the channel has a bulbous profile corresponding to the bulge.

In certain embodiments, the invention comprises an additional horizontally elongated member mounted to the top surface of the door, and the at least one sliding element mounted to the top surface of the door comprises a plurality of sliding elements affixed to the additional horizontally elongated member. In some cases, the additional horizontally elongated member comprises an elongated metal plate in a horizontal plane. In some of these embodiments, the elongated metal plate has a plurality of through holes through which a plurality of screws is screwed into the top surface of the door.

In certain advantageous embodiments, the channel is at least partially defined by a wall, the wall having at least one race with a plurality of ball bearings therein such that the ball bearings are rotated by the protuberance when the sliding element slides on the protuberance.

In some embodiments, the mounting portion comprises an elongated metal plate disposed in a horizontal plane. In certain cases, the mounting portion further includes a plurality of screws, and a plurality of through holes in the elongated metal plate through which the screws are screwed into the support structure.

In certain advantageous embodiments, where the door includes a front wall and a back wall opposite the front wall, and where the protuberance includes an aperture, the system further includes a vertically extending rod positioned between the front and back walls of the door, the rod having a top end, and an actuator located on at least one of the front and back walls of the door for moving the rod between an unlocked position and a locked position. When the actuator moves the rod from the unlocked position to the locked position, the actuator moves the rod upwardly such that the top end of the rod is advanced into the aperture of the protuberance, and when the actuator moves the rod from the locked position to the unlocked position, the actuator moves the rod downwardly such that the top end of the rod is withdrawn from the aperture of the protuberance. In some of these embodiments, the actuator comprises a thumb-turn lock.

In some embodiments, where the door includes a front wall and a back wall opposite the front wall, the system further includes an elongated metal plate affixed to at least one of the front and back walls of the door adjacent the top thereof such that the plate covers the at least one sliding element mounted to the top surface of the door. In some of these embodiments, the system includes a horizontally elongated skirt mounted above the mounting portion of the elongated member and overlapping at least part of the elongated metal plate.

In certain embodiments, the system further includes a floor guide adapted to be secured to a floor, and the door has a bottom surface with a guide channel therein corresponding to the floor guide and in which part of the floor guide is disposed such that the guide channel is slidable over the floor guide.

In some embodiments, the system further includes a shoe adapted to be secured to a floor, the shoe having a cavity that receives a lower corner of the door. In certain embodiments, the door has a vertically elongated end wall, and the system further includes a door stop mounted to the horizontally elongated track, the door stop having a metal wall disposed in a vertical plane that engages the vertically elongated end wall of the door.

In certain embodiments, the system further includes a frame configured to be mounted to the surface of a wall around a door opening, the frame comprising a right vertical member, a left vertical member, and a horizontal member supported by the right and left vertical members, and the horizontal member comprises the support structure. In some of these cases, where the door includes a back wall, the system further includes an elongated metal plate have a width and affixed to back wall of the door adjacent the top thereof such that the plate covers the at least one sliding element mounted to the top surface of the door, and, when the frame is mounted to the wall around the door opening, the distance between the back wall of the door and the wall around the door opening is approximately equal to the width of the plate. In some cases, the distance is approximately ⅛ of an inch.

In some embodiments, the support structure is a horizontal beam configured to be mounted to the surface of a wall above a door opening. In other embodiments, the support structure is a ceiling.

In certain advantageous embodiments, the door is a barn-style door.

In some embodiments, the system further includes an end cap adjacent the sliding element, the end cap having a channel therein corresponding to the channel of the sliding element.

In another embodiment, the invention comprises a sliding door system, including a door having a top surface, and a first horizontally elongated member having a mounting portion with which the first horizontally elongated member is mounted to a support structure and a horizontally elongated track extending downwardly from the mounting portion. The horizontally elongated track comprises a horizontally elongated upper portion having a width, and a horizontally elongated protuberance below the upper portion having a width greater than the width of the upper portion. The system further includes a second horizontally elongated member mounted to the top surface of the door, the second horizontally elongated member having a channel corresponding to the protuberance and in which part of the elongated protuberance is disposed such that second horizontally elongated member is retained by and slidable on the protuberance.

In certain advantageous embodiments, the channel has a horizontally elongated opening along the top thereof that accommodates the horizontally elongated upper portion of the track as the second horizontally elongated member slides on the protuberance. In some cases, the protuberance comprises a bulge, and the channel has a bulbous profile corresponding to the bulge.

In some of these embodiments, the horizontally elongated upper portion of the track comprises first and second portions corresponding to first and second portions, respectively, of the horizontally elongated opening along the top of the channel, and the first portion of the horizontally elongated opening is defined by vertical inner walls of the second horizontally elongated member, and the second portion of the horizontally elongated opening is defined by chamfered inner walls above the vertical inner walls of the second horizontally elongated member. In some cases, the lower channel portion has a width, and the horizontally elongated opening along the top of the channel has a width greater than the width of the lower channel portion. In some of these embodiments, the protuberance has a diameter greater than the first portion of the horizontally elongated upper portion of the track, and in some cases, the protuberance has a diameter greater than the width of the second portion of the horizontally elongated upper portion of the track.

DETAILED DESCRIPTION OF THE INVENTION

The following detailed description illustrates the technology by way of example, not by way of limitation, of the principles of the invention. This description will enable one skilled in the art to make and use the technology, and describes several embodiments, adaptations, variations, alternatives and uses of the invention, including what is presently believed to be the best mode of carrying out the invention. One skilled in the art will recognize alternative variations and arrangements, and the present technology is not limited to those embodiments described hereafter.

Figure 1:
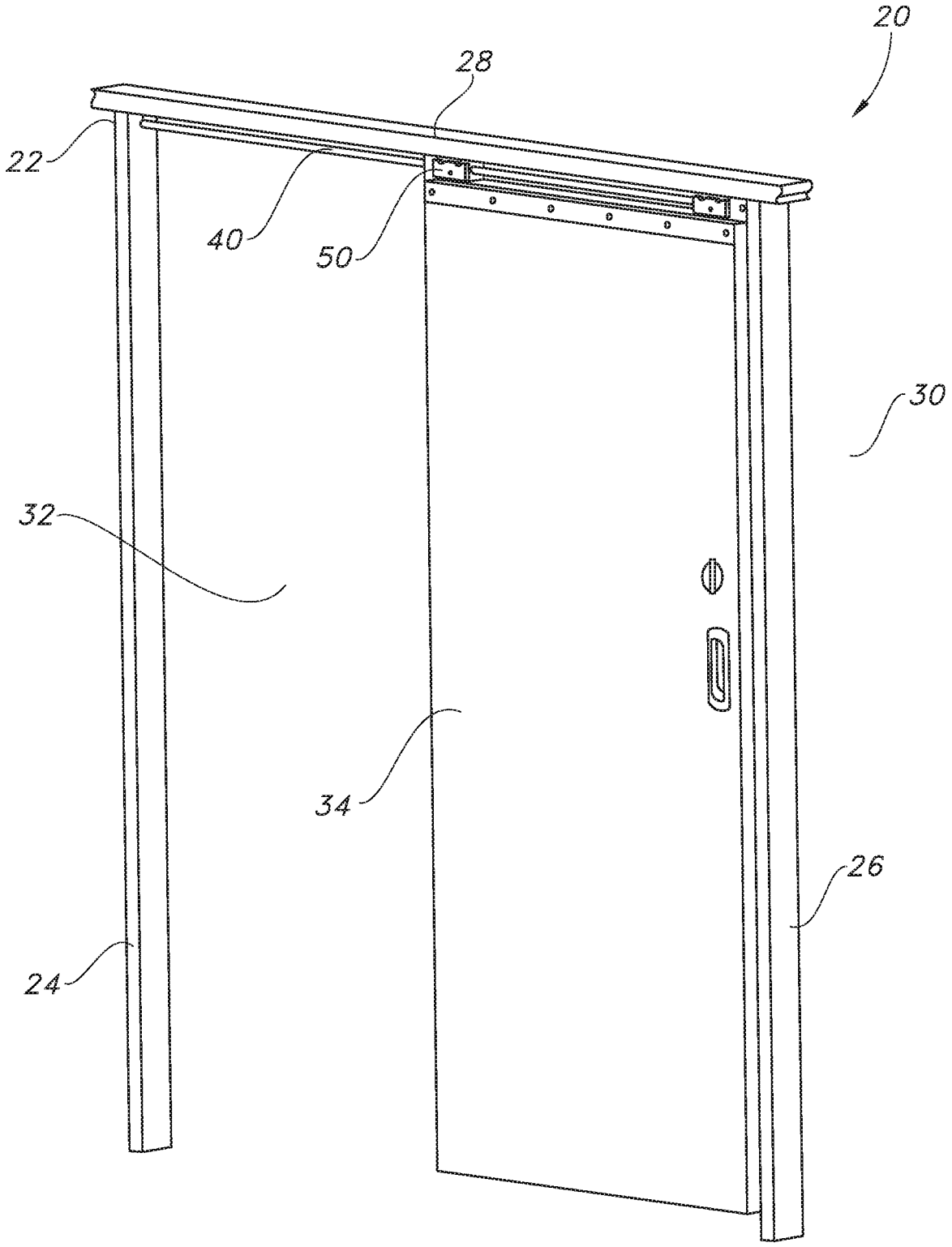
FIG. 1 is a perspective view of a sliding door system in accordance with the invention.

FIG. 1 illustrates one exemplary embodiment of a sliding door system (20) in accordance with the invention. In the illustrated embodiment, the system (20) includes a frame (22) having a left side portion in the form of a vertical stud (24), a right side portion in the form of another vertical stud (26), and a top portion in the form of a horizontal beam or header (28) supported by the studs (24), (26). The frame (22) can be surface-mounted to a wall (30) to cover an opening provided therein or retrofit an existing doorway.

A first horizontally elongated member (40) is mounted to the header (28) of the frame (22), and a second horizontally elongated member (50) is mounted to the top surface of a door (34). The first and second horizontally elongated members (40), (50) are engaged such that the door (34) is slidable relative to the frame (22), as is further described below. The various parts of the first and second horizontally elongated members (40), (50), further described below, are fashioned from metal, such as steel and/or aluminum.

Figure 2:
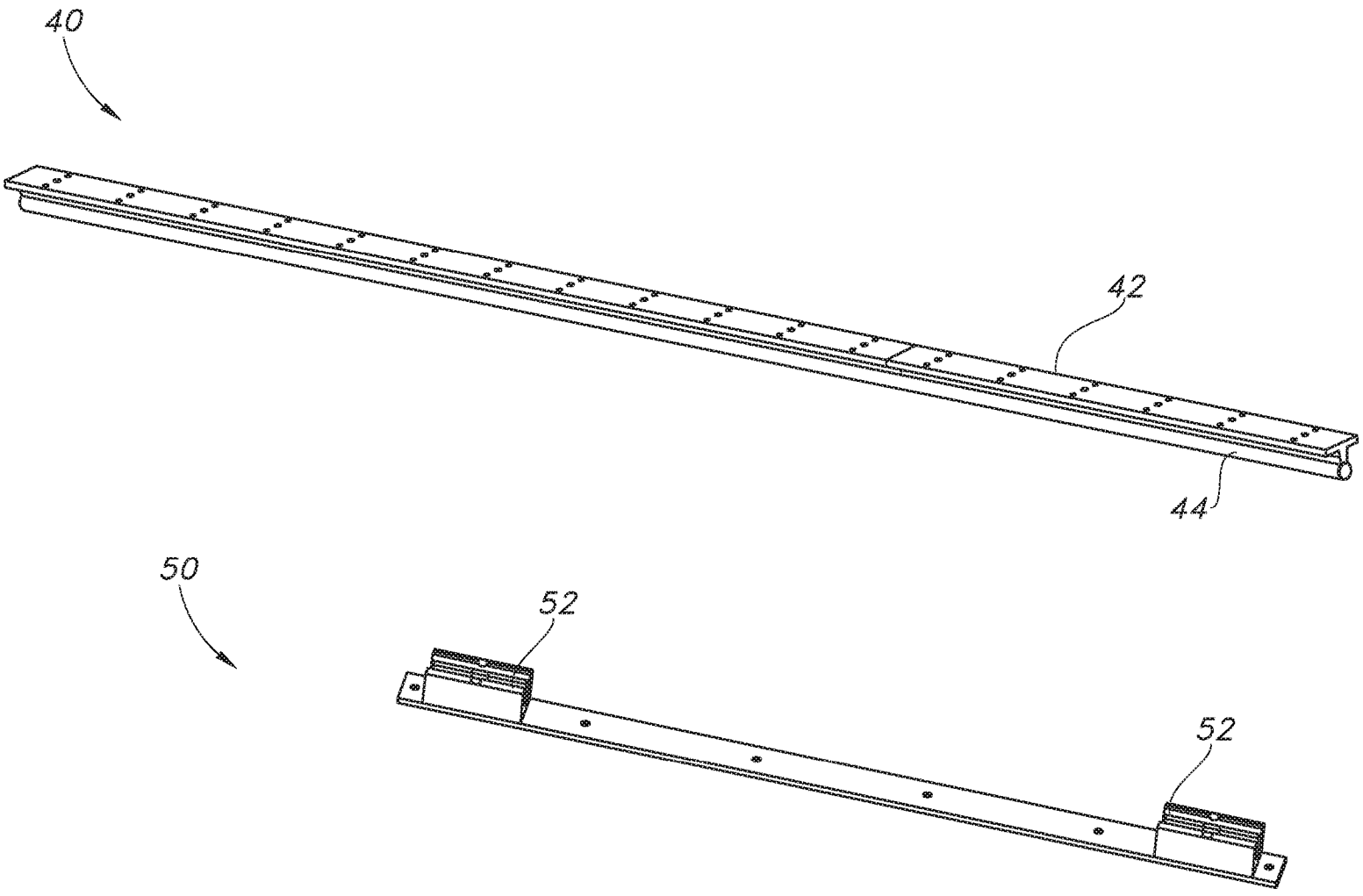
FIG. 2 is a perspective view of the first and second elongated members of the door sliding system of FIG. 1.
Figure 3:
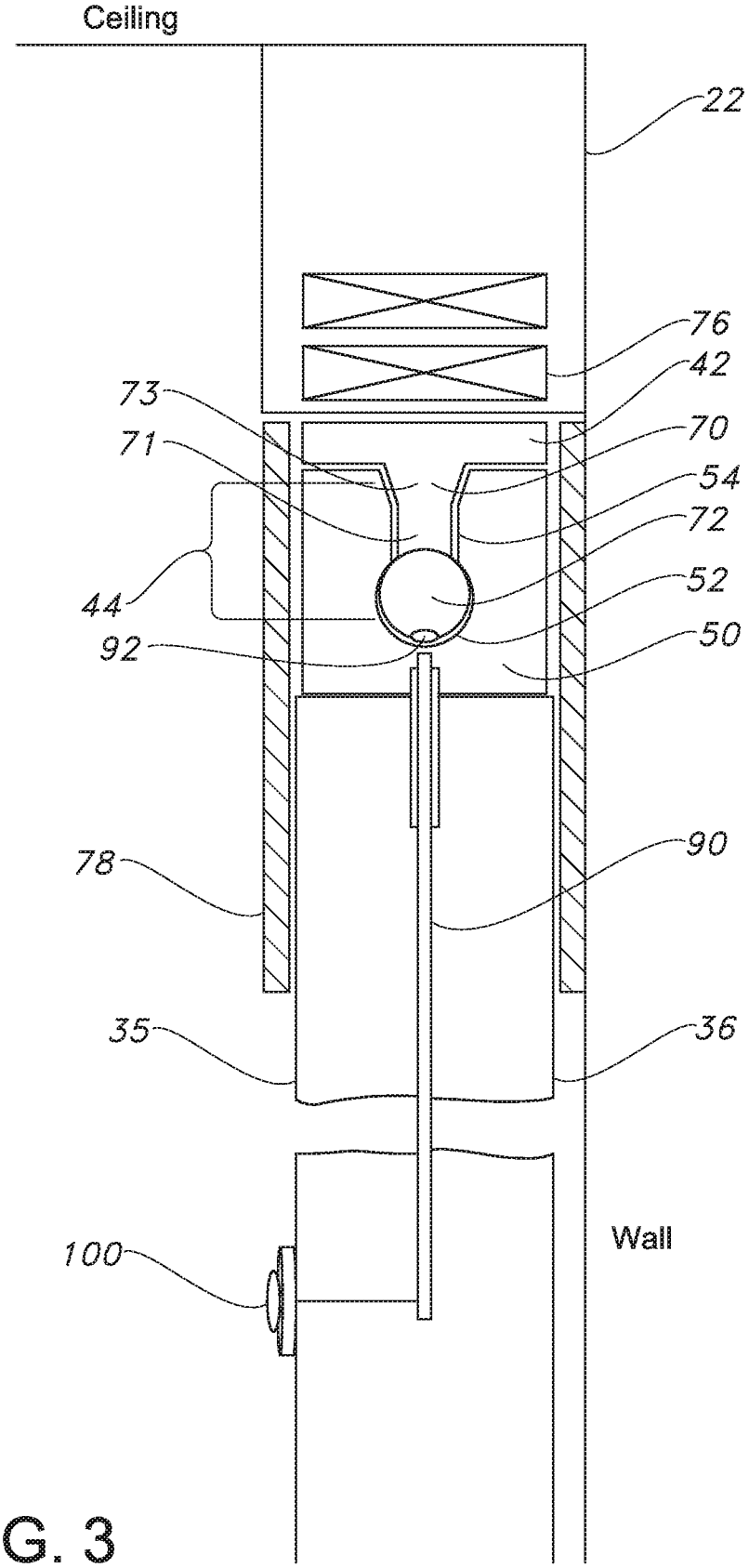
FIG. 3 is a schematic end view of the cooperation between different components of the sliding door system of FIG. 1.

Referring to FIGS. 2-3, the first horizontally elongated member (40) includes a mounting portion (42) for mounting the member (40) to the header (28) or other support structure, as further described below. The mounting portion (42) also includes an elongated track (44), which engages the second horizontally elongated member (50). The second horizontally elongated member (50), which is mounted to the top surface of the door (34), includes at least one channel (52) for accommodating a part of the elongated track (44), as described in further detail below.

Figure 4A:
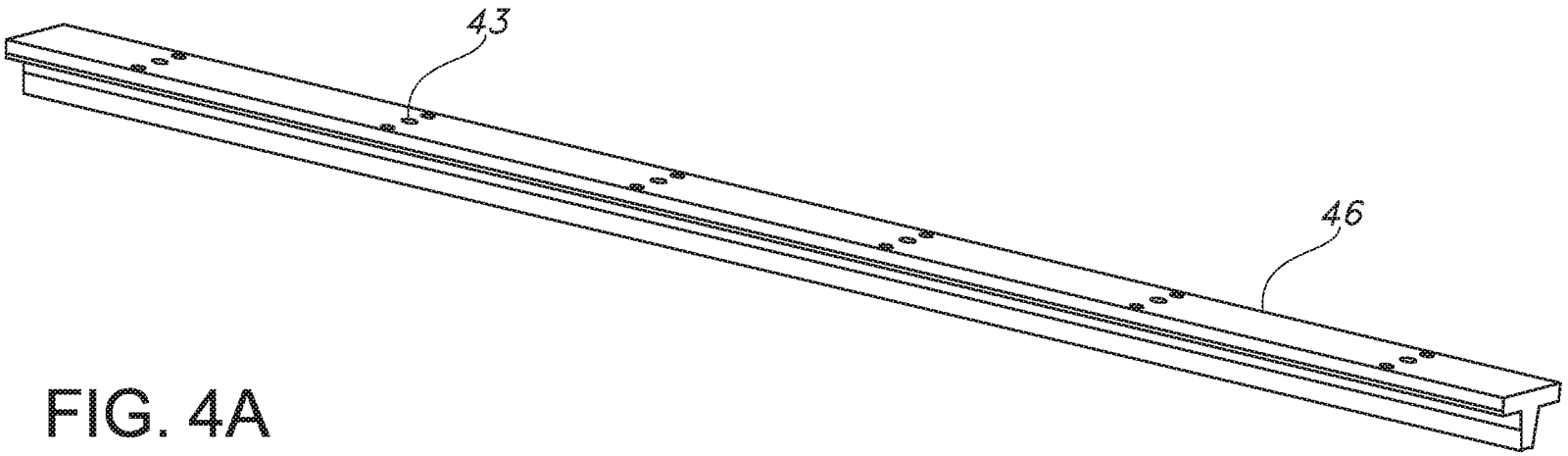
FIGS. 4A-B are perspective views of parts making up the first elongated member of FIG. 2.
Figure 4B:
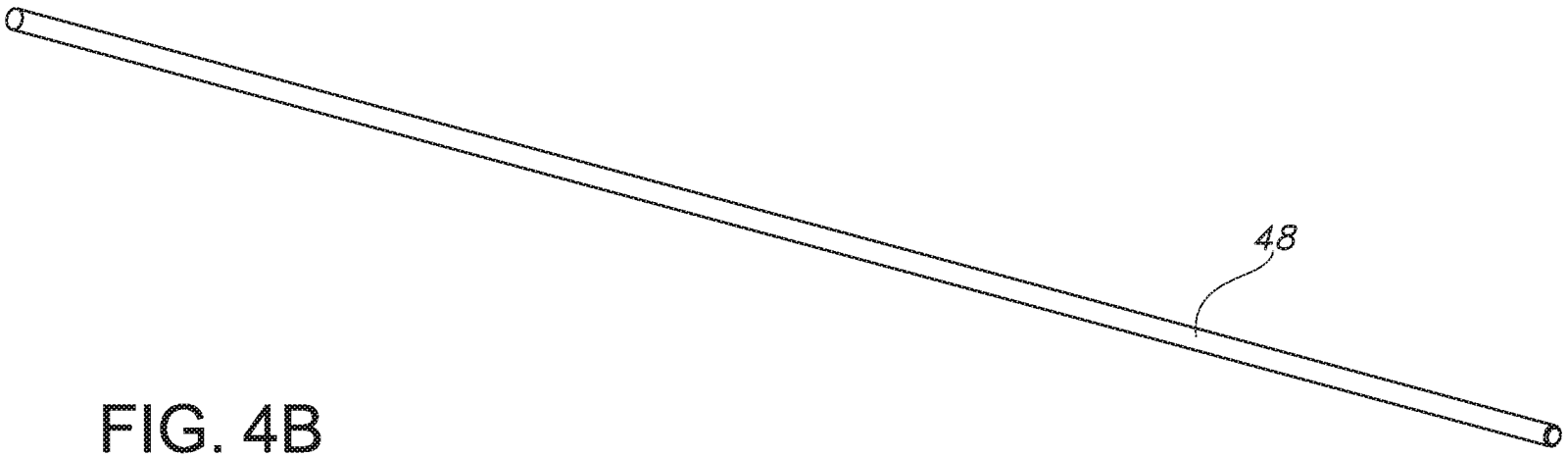

As shown in FIGS. 4A-B, the first horizontally elongated member (40) may be fashioned from a rail (46), and a shaft (48) with tapped holes for subsequent securing the shaft (48) to the rail (46). In this case, and as shown most clearly in FIG. 3, the top of the rail (46) forms the mounting portion (42), while the bottom of the rail (46) and the shaft (48) together form the track (44) mentioned above. It should be noted, however, that alternative ways of producing the first horizontally elongated member (40) may be employed, such as by manufacturing the member (40) as a single, integrally formed piece.

The mounting portion (42) comprises a flat, metal sheet (i.e., lying in a horizontal plane) with plurality of through holes (43) therein, through which screws are screwed in order to mount the member (40) to a support structure, such as header (28). If desired, tamper resistant fasteners can be used. As will be apparent to those skilled in the art, a mounting system other than the illustrated hole and screw arrangement can be used. Additionally, the mounting portion (42) need not necessarily comprise a long, unitary piece extending the entire length of the door, but rather, may comprises a sequence of smaller, discrete mounting pieces. It should also be noted that, in some applications, the mounting portion (42) can be configured differently than as is shown if, for example, it was desired for the track to be mounted from a ceiling or off a wall, instead of being mounted within a frame, as is further described below. Any way of securing the first horizontally elongated member (40) such that the track (44) extends downwardly may be employed.

Figure 5A:
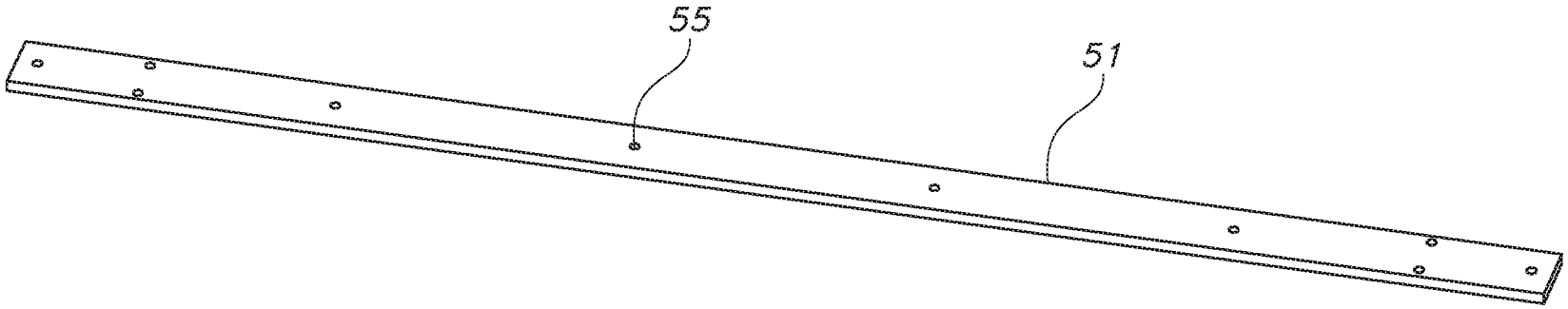
FIGS. 5A-B are perspective views of parts making up the second elongated member of FIG. 2.
Figure 5B:
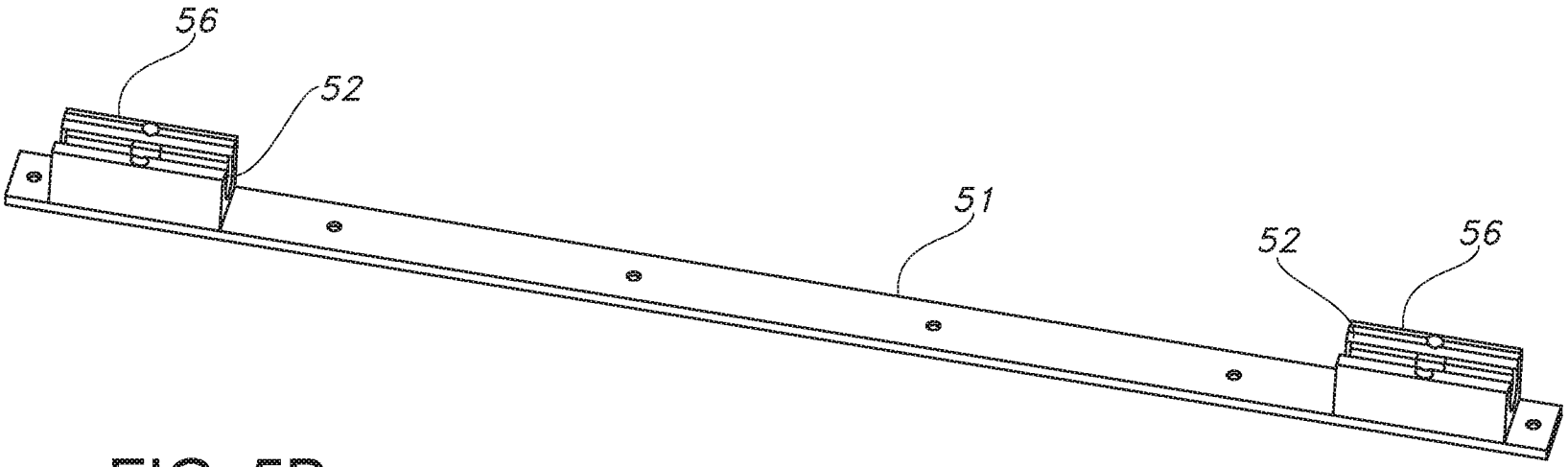

As shown in FIGS. 5A-B, the second horizontally elongated member (50) may be fashioned from the flat metal plate (51) with one or more sliding elements (56) affixed thereto. The plate (51) has a plurality of through holes (55) therein, through which screws are screwed in order to mount the member (50) to the door (34). Again, tamper resistant fasteners can be used if desired, and, as will be apparent to those skilled in the art, a mounting system other than the shown hole and screw arrangement can be used. It should be noted, however, that other configurations of the second horizontally elongated member (50) may be employed.

It should also be noted that the one or more sliding elements (56) need not be mounted to the top surface of the door (34) via the second elongated member (50) as described above, but can also be mounted directly to the top surface of the door (34). For example, a single sliding element may be directly mounted to the top surface of the door (34) and extend along the entire length thereof, or a plurality of sliding elements (56) may be mounted to the top surface of the door at both ends thereof, and possibly at other points along its length.

Figure 6A:
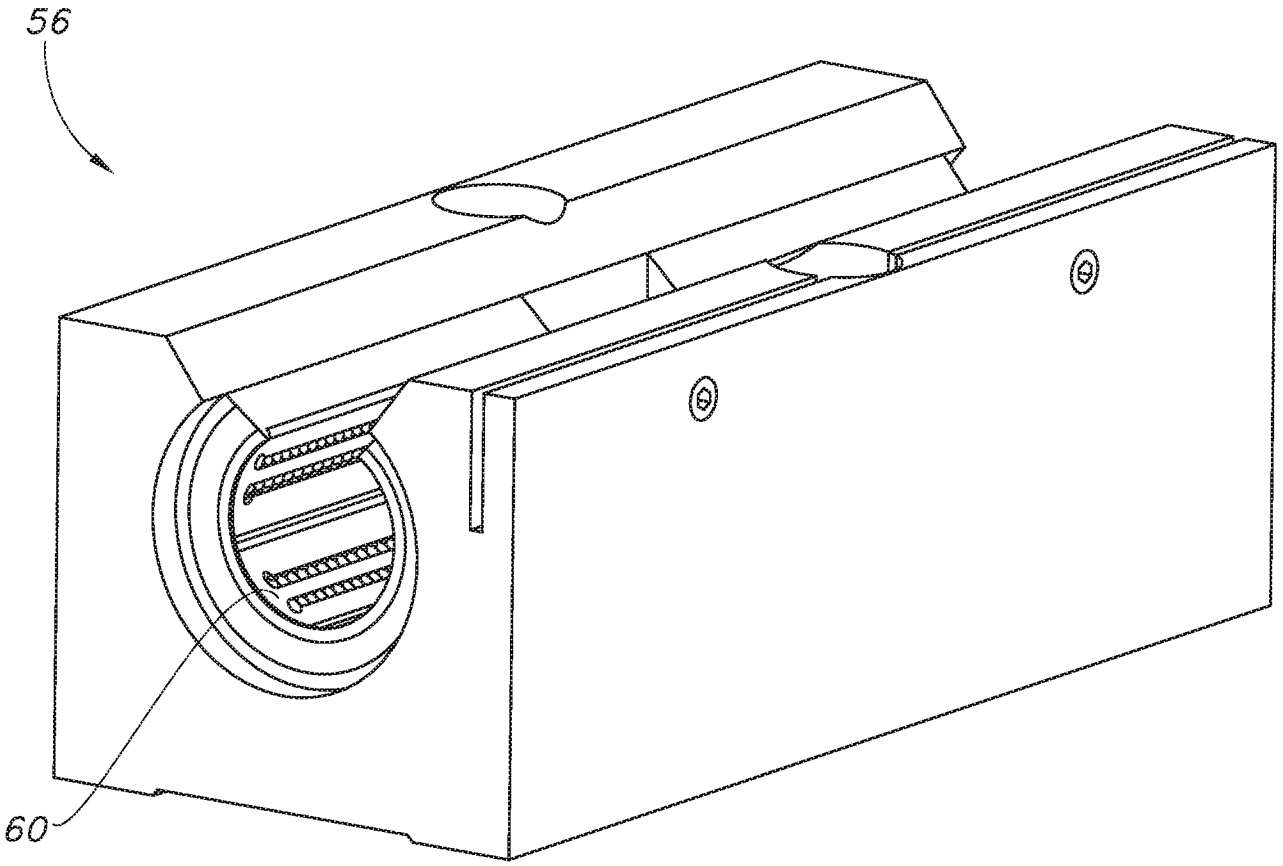
FIG. 6A is a perspective side view of the sliding element of the second elongated member of FIGS. 5A-B.
Figure 6B:
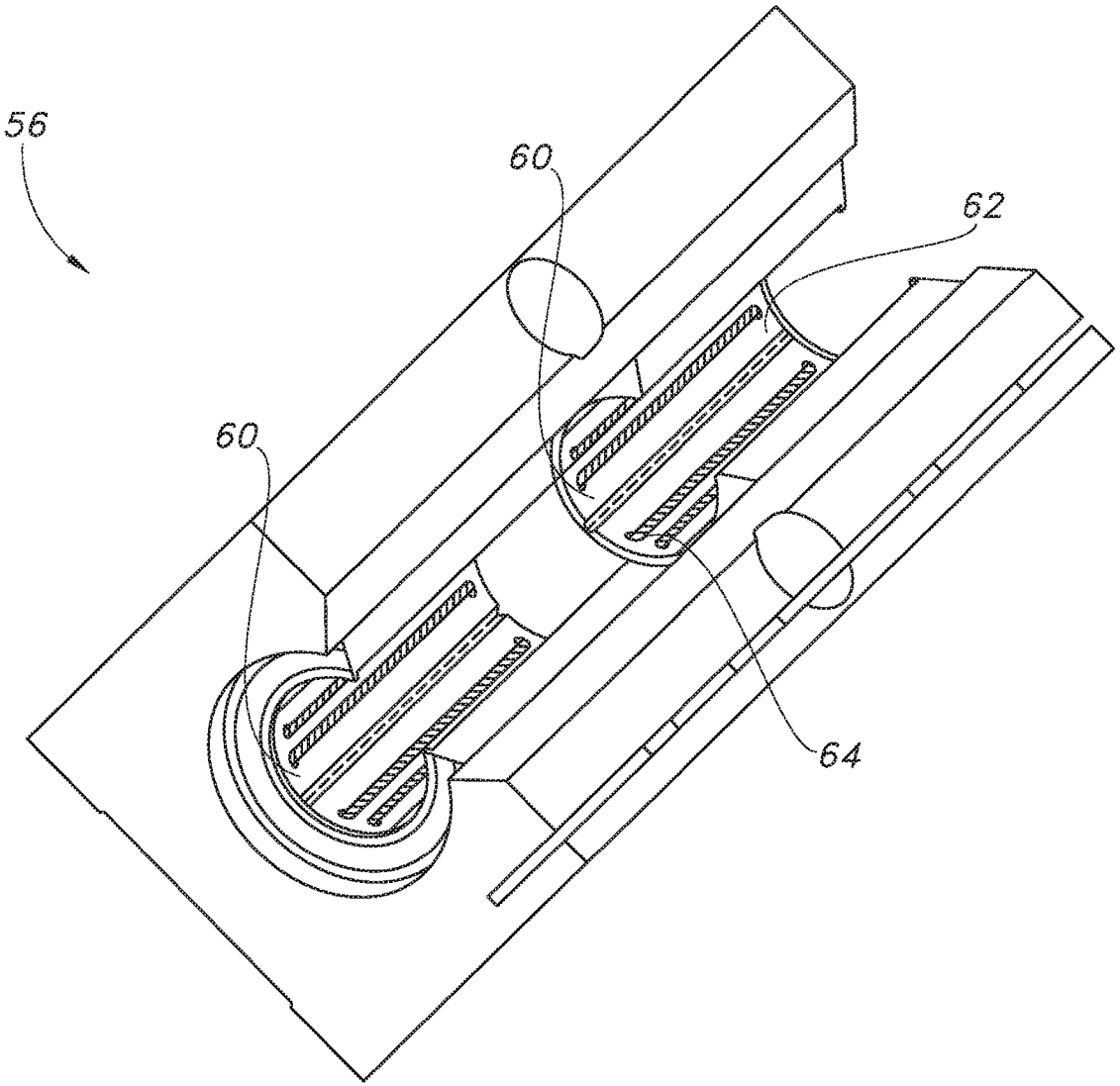
FIG. 6B is a perspective top view of the sliding element of FIG. 6A.

As shown in FIGS. 6A-B, in certain advantageous embodiments, each sliding element (56) includes one or more ball bearing slides (60). In the example illustrated, for each slide (60), the wall (62) of the channel (52) contains four races (64), each containing a plurality of ball bearings therein.

Returning to FIG. 3, the first horizontally elongated portion (40) includes the mounting portion (42) and the track (44) extending downwardly from the mounting portion (42). The track (44) includes a horizontally elongated upper portion (70) and a horizontally elongated protuberance (72) below the upper portion (70). The protuberance (72) has a width that is wider than the width of the upper portion (70) such that, when the track (44) is disposed in the channel (52), the protuberance (72) retains the sliding element (56), such that the sliding element (56) hangs therefrom.

In the illustrated embodiment, the track (44) is a rounded bulge extending down from the mounting portion (42), and the channel (52) has a bulbous profile corresponding to the bulge. The channel (52) includes a horizontally elongated opening (54) along the top thereof for accommodating the horizontally elongated upper portion (70) of the track (44), such that the track (44) is freely slidable along the channel (52).

In certain advantageous embodiments, the upper track portion (70) is designed to further improve the performance of, and decrease the stress on, the sliding system. The upper track portion (70) includes a first portion (71) that extends up from the protuberance (72). This narrower section is defined by vertical inner walls of the second horizontally elongated member (50). A second portion (73) is located above the first portion (71) and widens as it extends upwardly. This wider, tapered portion is defined by chamfered inner walls above the vertical inner walls of the second horizontally elongated member (50). The protuberance (72) has a diameter that is greater than the width of the first portion (71), and that may also be greater than the width of the second portion (73).

As a result of this design, the horizontally elongated opening (54) along the top of the channel (52) provides a partially tapered upper track portion (70). First, this provides greater structural integrity than would otherwise exist with a single, ninety-degree bend in the upper track portion (70), which could provide an undesirable fracture point. Additionally, if the door is tilted slightly forward or backward, this tapered shape of the upper track portion (70) reduces the chance of excessive localized friction at a single point on the track.

Figure 7:
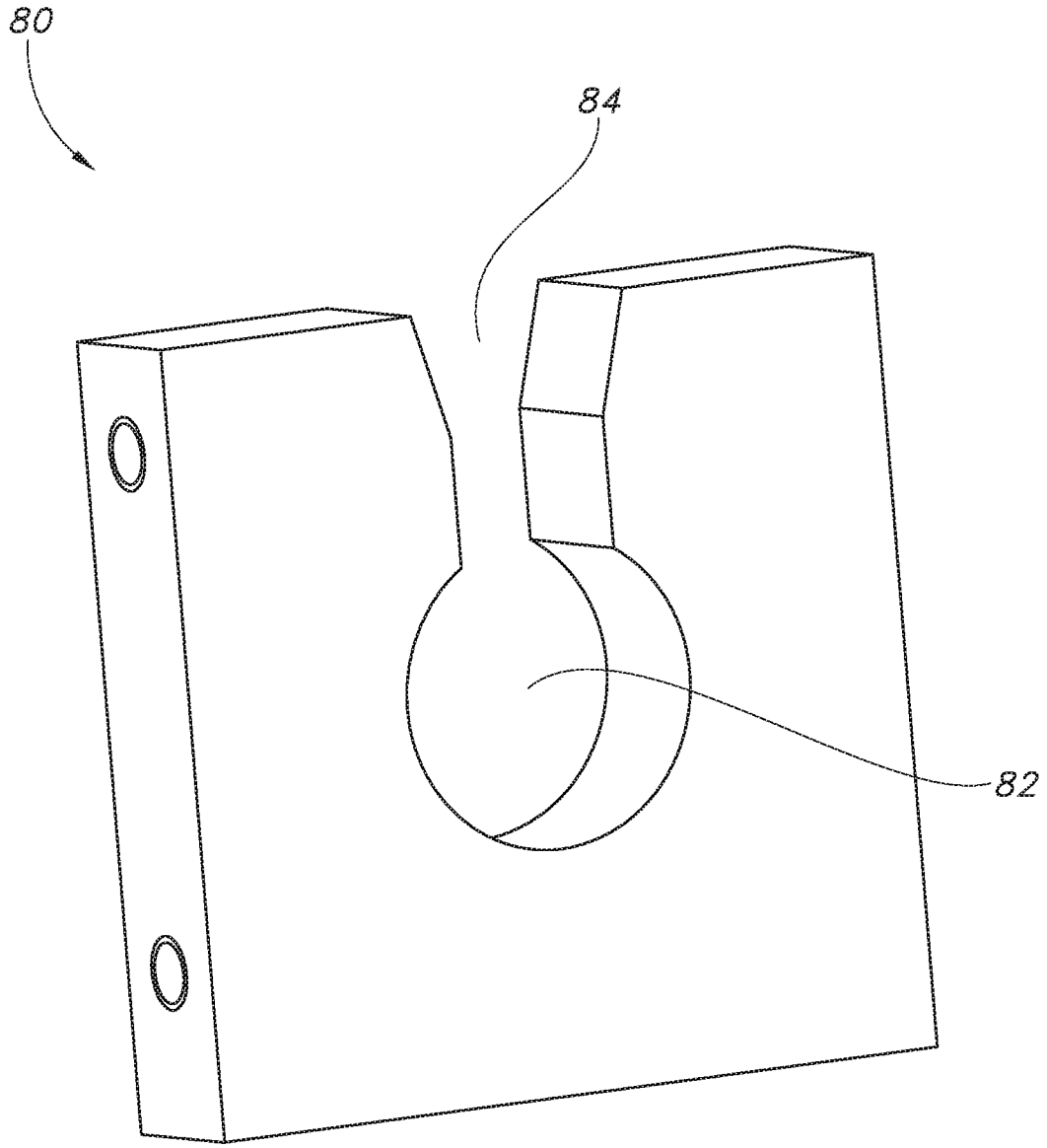
FIG. 7 is a perspective view of and end cap for the sliding door system of FIG. 1.

Referring to FIG. 7, an end cap (80) is placed at the left and right ends of the door to stop and cushion the door (34) when it is slid against the left and right studs (24), (26). To facilitate this, the end cap (80) includes a channel (82) corresponding to the channel (52), and an opening (84) on the top thereof corresponding the opening (54). The end cap may be fashioned from high density rubber, which mitigates damage and noise from slamming the door. In combination with the sliding element (56), the end cap (80) ensures operation of the door with minimal noise.

Figure 8:
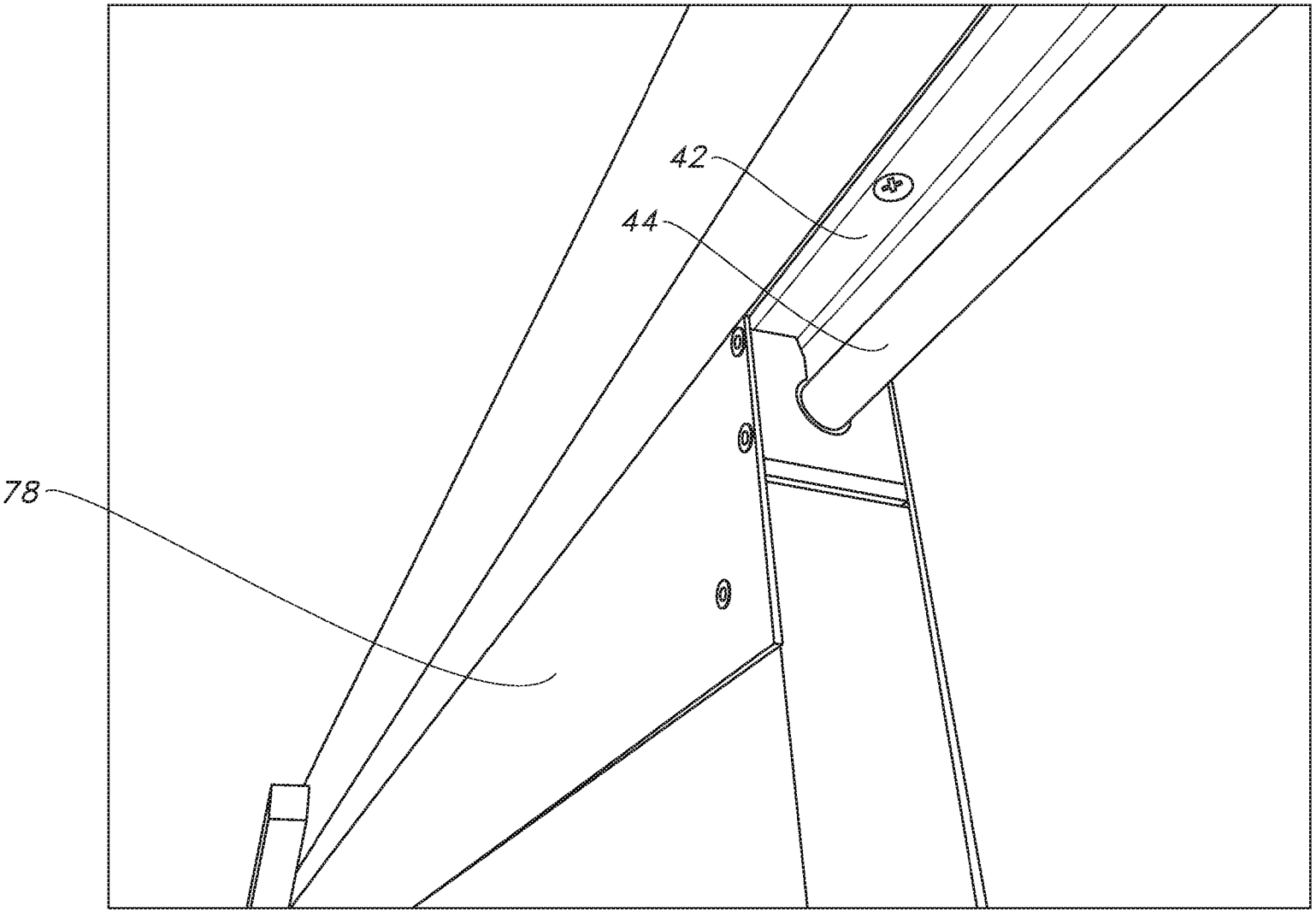
FIG. 8 is a perspective view of part of the sliding door system of FIG. 1.

Various reinforcing means, such as metal reinforcing plates, can be provided, both to provide structural support for the assembly and to inhibit tampering. For example, referring again to FIG. 3, one or more reinforcing members (76) may be provided, to which the mounting section (42) is secured. As also shown in FIG. 3, as well as in FIG. 8, an elongated, flat metal plate (78) may be provided at the top of one or both sides of the door (34). The metal plate (78) extends the entire length of the door and has a top edge that is flush with the top edge of door. As a result, the plate (78) not only further supports the mounting of the second elongated member (50) to the top surface of the door (34), but it also covers the entire member (50), such that, in embodiments employing discrete sliding elements (56) along the top surface of the door (34), use of these as ligature points is prevented.

As a result of this track and slide assembly, the second elongated member (50) is retained by the track (44) such that it hangs therefrom, and it is slidable thereon with the aid of the sliding elements (56). With this configuration, there are no wheels that may be knocked off, or out of, a rail or the like. In fact, there is essentially no way at all for the door to be unintentionally removed from the track, as removal therefrom would require the intentional disassembly of several components. Additionally, there are no components in this configuration that can serve as a ligature point in those environments where this is a concern.

Figure 9:
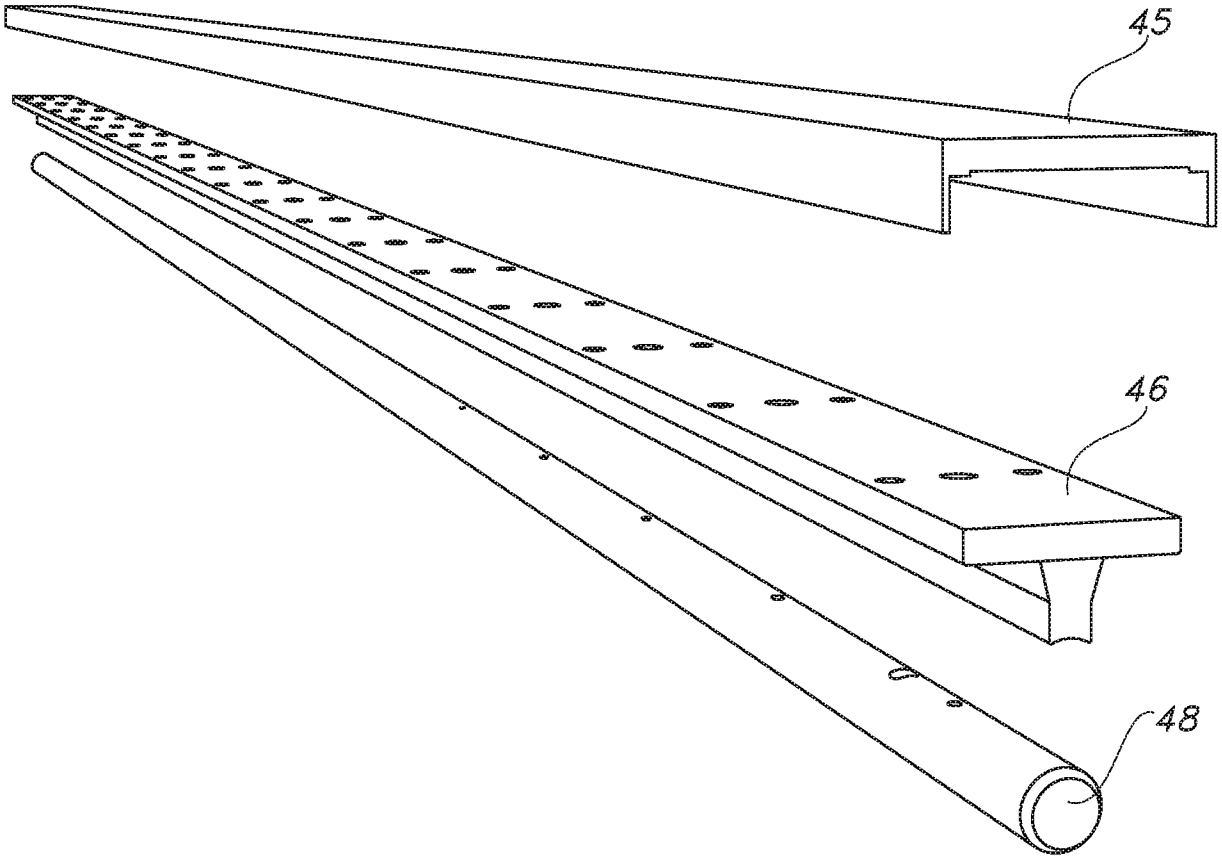
FIG. 9 is a perspective view of the parts of FIGS. 4A-B with an upper skirt.
Figure 10:
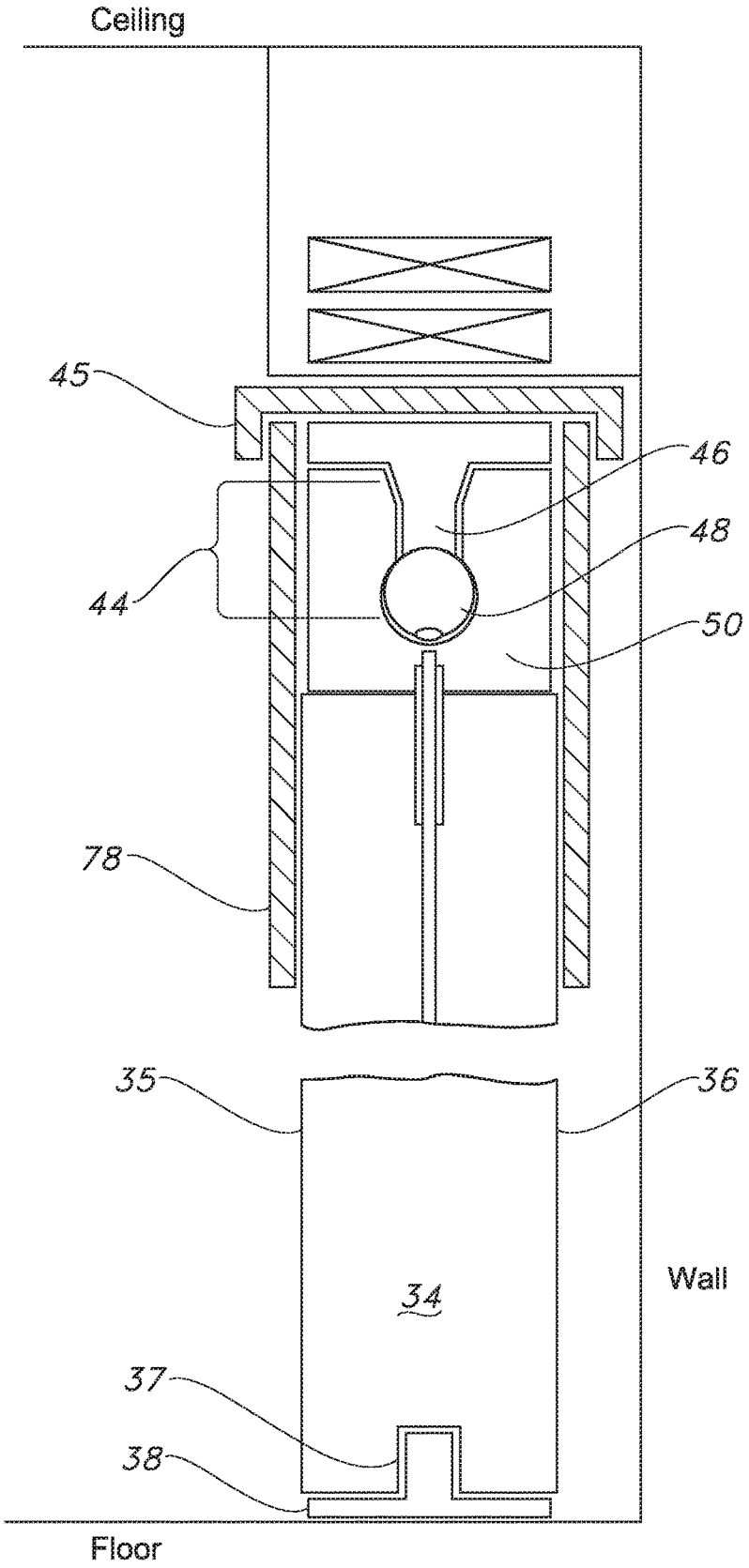
FIG. 10 is a schematic view a schematic end view of the components of the sliding door system of FIG. 3 including the upper skirt of FIG. 9 and a floor guide.

Referring to FIGS. 9-10, in certain advantageous embodiments, an elongated upper skirt (45) positioned above the rail (46) and shaft (48) that form the first horizontally elongated member (40). The edge of the skirt (45) overlaps the top of the plate (78) that conceals the first and second elongated members (40), (50). As a result, the skirt (45) ensures that there is no lip or edge along the top of the plate (78) over which one might try to secure a ligature.

In some embodiments, the door (34) includes a channel (37) along its bottom, and a concealed floor guide (38) corresponding to the channel (37) is secured to the floor. The channel (37) slides along the guide (38) as the door is slid open and closed, such that the guide (38) prevents the door (34) from being pushed outwardly or inwardly. By doing so, individuals are prevented from using the door (34) as a weapon, and the ability to "penny lock" or barricade the door (34) is hampered.

Figure 11A:
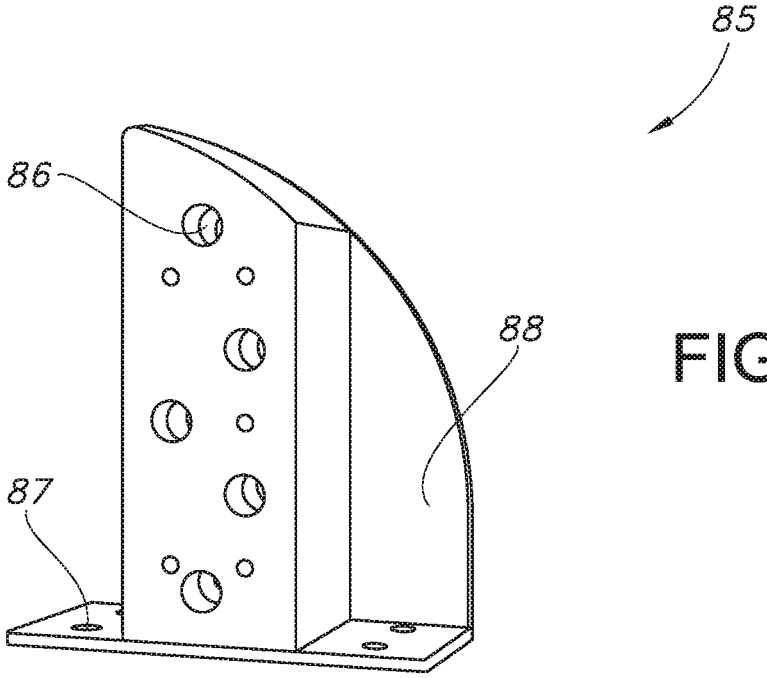
FIGS. 11A-B are perspective views of a shoe for use with the sliding door system of FIG. 1.
Figure 11B:
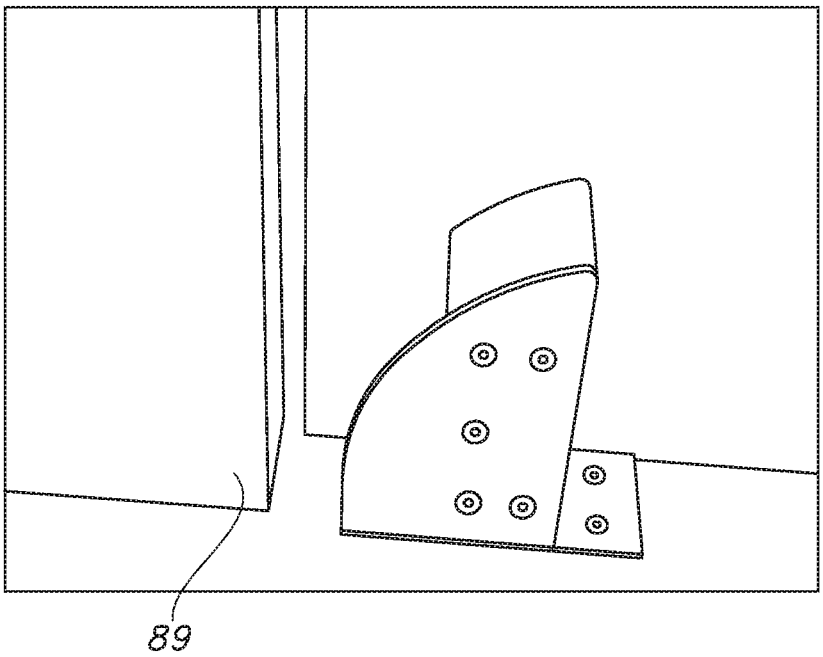

Additionally, as shown in FIGS. 11A-B, in some embodiments, a shoe (85) is provided. The shoe (85) includes a plurality of screw holes (86) with which the shoe is secured to the wall, and a plurality of screw holes (87) with which it is secured to the floor. The shoe (85) is positioned such that a cavity (88) catches the lower leading edge (89) of the door when in the closed position. As a result, the shoe provides greater structural integrity against lateral forces applied to the door, such as may occur in patient environments.

Figure 12:
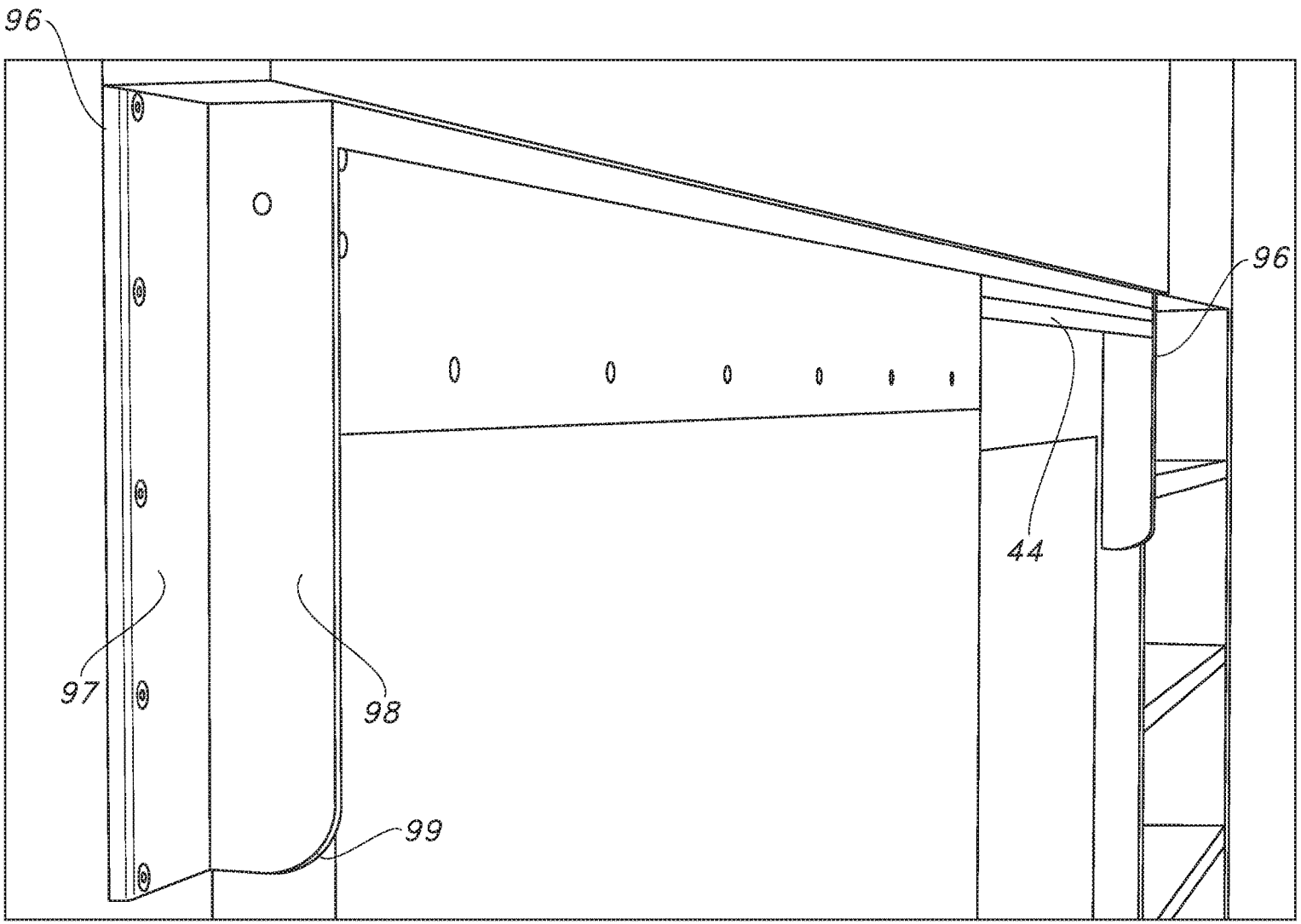
FIG. 12 is a perspective view door stops for use with the sliding door system of FIG. 1.

As shown in FIG. 12, in certain embodiments, door stops (96) are also provided. The door stop (96) has a first plate (97), which is mounted to the wall. The stop (96) includes a second plate (98), perpendicular to the first plate (97) and mounted to the track (44), for engaging the long end of the door and stopping it from sliding. The second plate (98) includes a rounded lower corner (99) so that there is no protruding right angle on which an individual could injure themselves.

Referring again to FIG. 3, between the front wall (35) and back wall (36) is a vertically oriented rod (90). The rod (90), which is concealed from view and cannot be directly accessed from either side of the door, can be moved up and down to lock and unlock the door using an actuator (100). When the actuator (100) moves the rod (90) from the unlocked position to the locked position, the rod (90) is moved upwardly such that the top end of the rod (90) is advanced into an aperture (92) of the protuberance (72). When the rod (90) is later moved from the locked position to the unlocked position, the rod (90) is moved downwardly, such that the top end of the rod is withdrawn from the aperture (92) of the protuberance (72).

As a result of this locking mechanism, there is no need for a traditional latch or bolt extending out from the edge of the door, which could be used as a ligature point. Since users of the door have no access to the rod (90) itself, the door is able to be locked and unlocked without presenting any ligature risks.

Figure 13A:
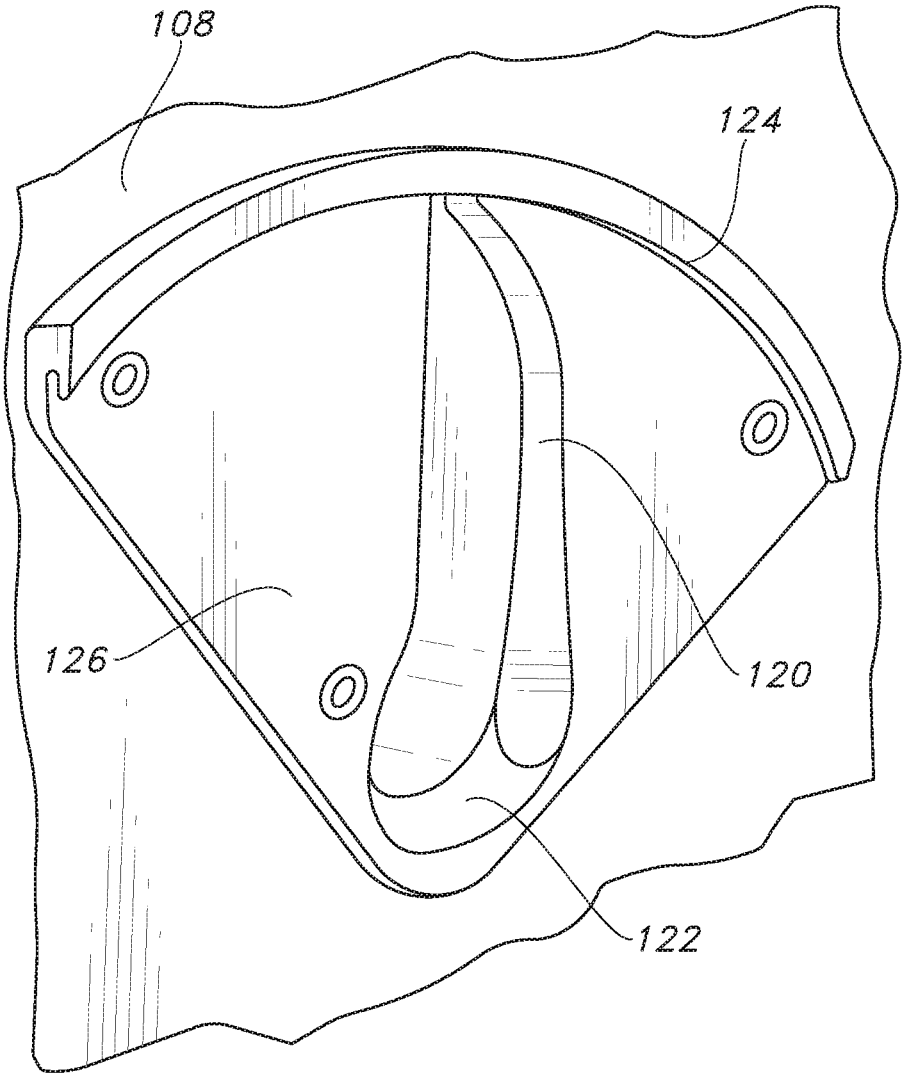
FIGS. 13A-B are perspective views of different versions of the thumb turn of FIG. 3.

The actuator (100) may comprise anti-ligature hardware, such as, for example, the thumb turn mechanism disclosed in U.S. Pat. No. 8,584,494 to Salvatore et al., the specification of which is hereby incorporated by reference herein in its entirety. For example, as shown in FIG. 13A, the actuator comprises an anti-ligature thumb turn (120). The thumb turn (120) may have a pivot point (122) at one end, which is in pivotal connection with a plate (126). The thumb turn (120) and plate (126) may be substantially close to one another to inhibit a ligature from being inserted therebetween. Further, the plate (126) may be affixed substantially close to a door (108) to inhibit a ligature from being inserted therebetween.

Figure 13B:
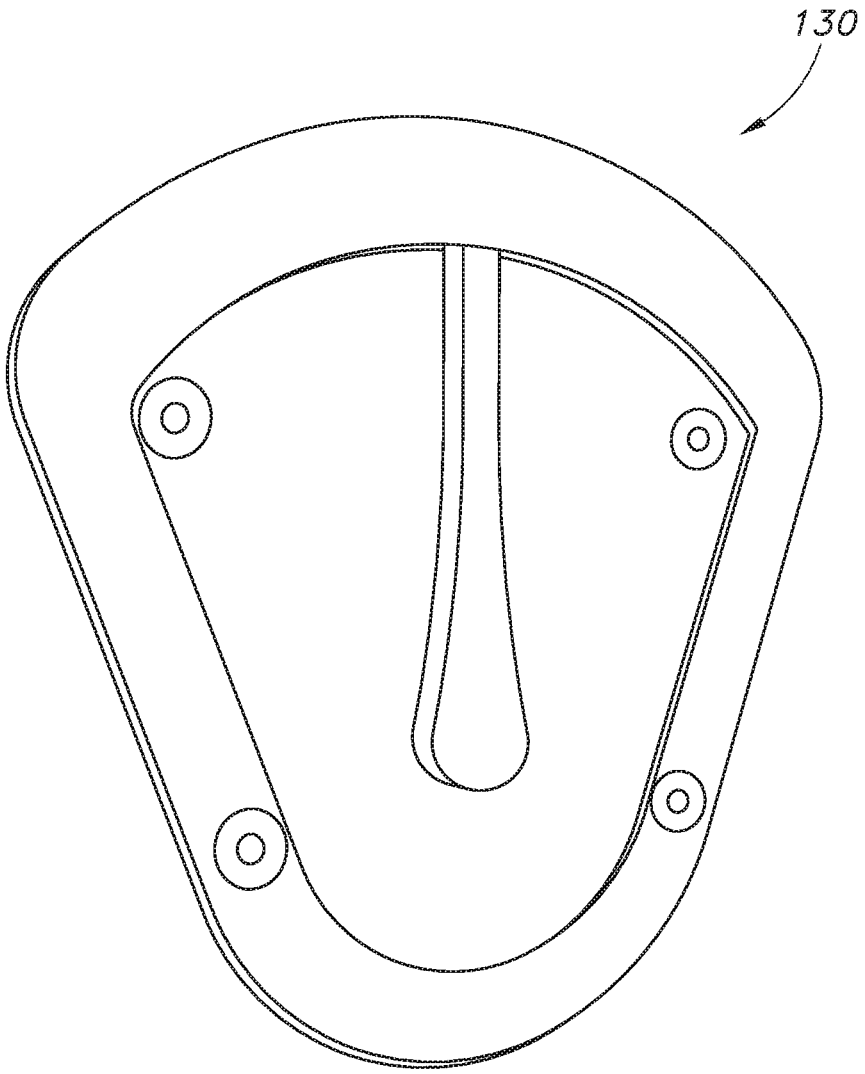

On the end of the thumb turn (120) opposite from the pivot point (122), although not limited thereto, there may be a retaining member on the plate (126), such as a railing (124). The railing (124) may be adjacent to the thumb turn (120) in order to retain it in place. If the railing (124) is substantially close with the thumb turn (120), it may inhibit someone from inserting a ligature therebetween. In one embodiment, the railing (124) may partially overlap the thumb turn (120) to further retain it in place and inhibit it from being dislodged. In other embodiments, as shown in FIG. 13B, a flush thumb turn (130), with no railing, is employed.

Since the thumb turn (120) may be coupled with the plate substantially near each of its ends (e.g., pivot point and railing), a person attempting suicide is unable to slip a ligature between the thumb turn (120) and the plate (126) in order to hang himself/herself.

The thumb turn (120) may further have a lock mechanism adapted for receiving a key. In this way, with the use of a key, a user may lock the thumb turn (120) to secure a door.

When the door (34) is fully closed and desired to be locked, the user turns the thumb turn (120) such that the hidden rod (90) moves upwardly and engages the aperture (92), as previously described. Thus, with this design, there is no latch, rod, or the like protruding from the edge or surface of the door (34) that would be capable of acting as an anchor for a string, rope, or the like in the event someone was trying to hang themselves.

As previously noted with reference to FIG. 1, the inventive assembly can be surface mounted against a wall having a standard door opening provided therein. The door (34) is generally sized to be slightly larger than the opening, and the frame (20) is positioned such that, in the closed position, the door covers the opening, and a portion (32) of the wall (30) will be visible through the frame. When the door is slid to the open position, the opening is exposed, and the previously visible portion (32) of the wall is now covered by the door. The door assembly can be surface mounted against the wall in this way and, as shown in FIG. 3, the design provides only a very small space (1/16") between the door and the wall when the door is slid open, which is the thickness of the plate (78). As a result, there is essentially no room for contraband to be hidden between the door (34) and the wall (32). In embodiments employing the skirt (45), the design still provides only a very small space (1/8") between the door and the wall when the door is slid open, which is the thickness of the plate (78) plus the thickness of the skirt (45).

Figure 14:
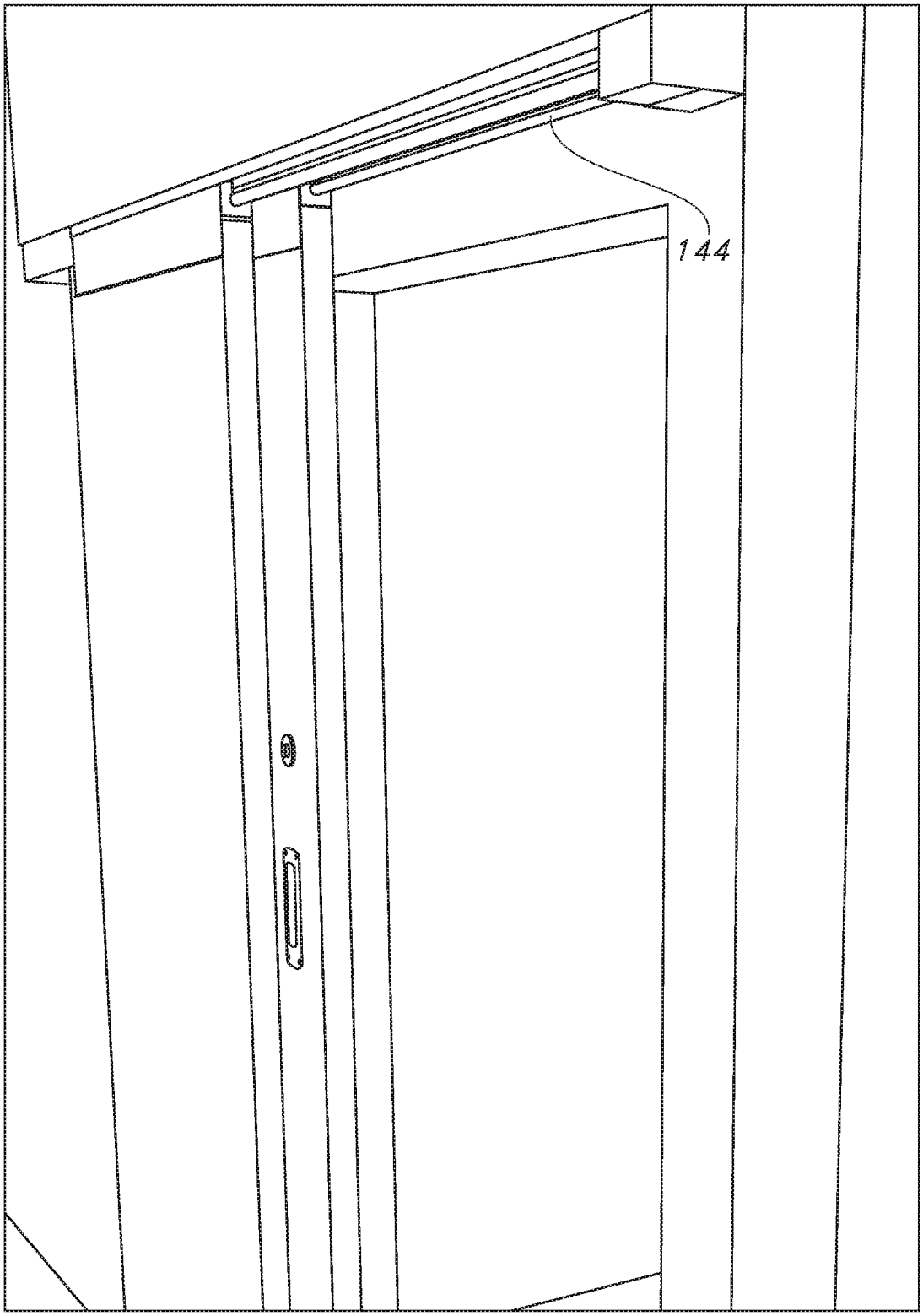
FIG. 14 is a perspective view of a double door sliding system employing the present invention.

As shown in FIG. 14, in instances where two sliding doors are desired, a double track (144) is mounted to the header or other structure, each side utilizing the same track and sliding system as described above.

Figure 15:
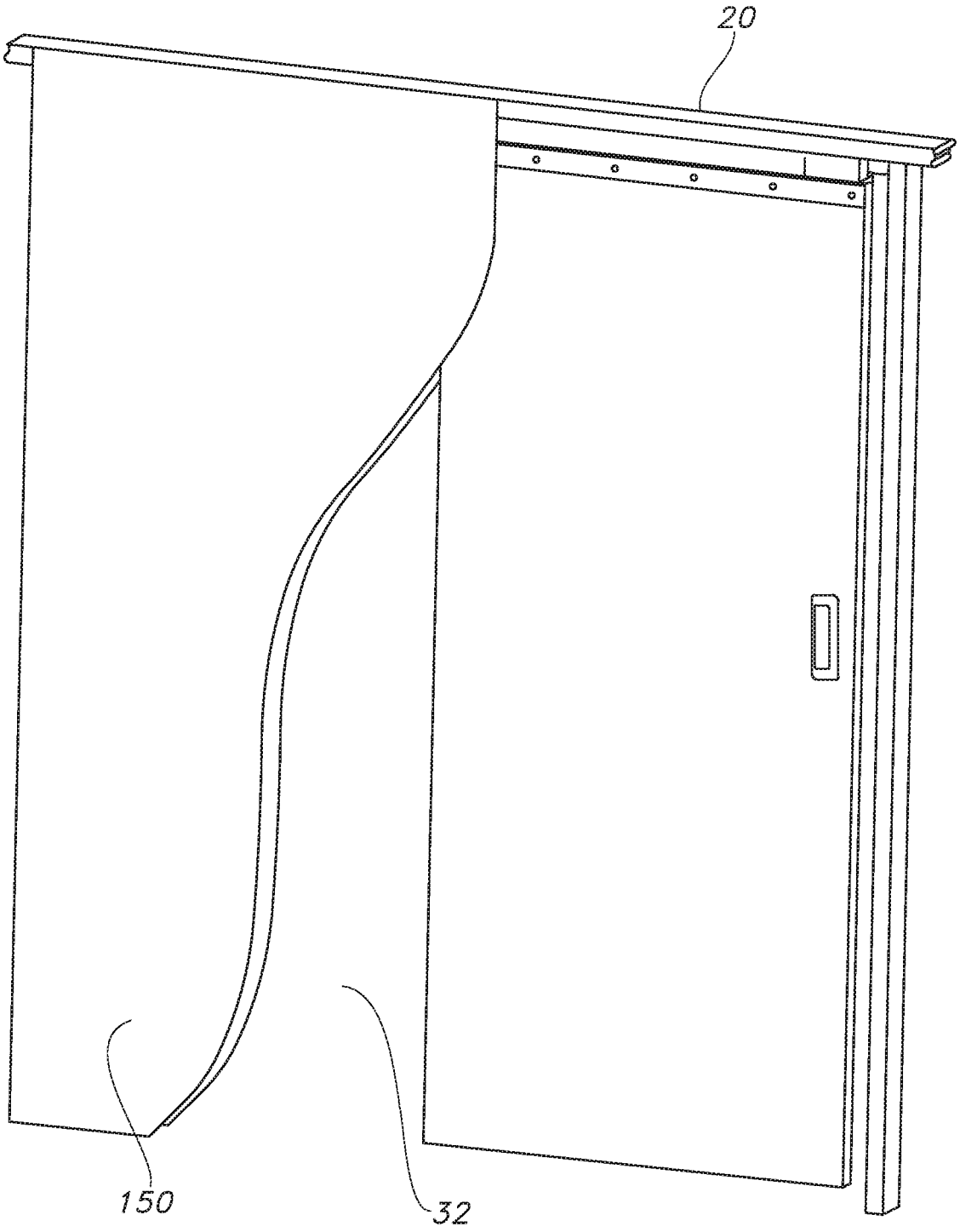
FIG. 15 is a perspective, partially exposed view of the sliding door system of FIG. 1 with a panel affixed to the frame.

As shown in FIG. 15, in some cases, one or more panels (150), such as sections of sheetrock, are affixed to the frame (20), such that the portion (32) of the wall that would normally be visible when the door is in a closed position will be concealed by the panels (150).

In other embodiments, however, a frame structure like frame (20) is not required, and the track and channel structure may be mounted to a ceiling, wall, or the like, depending on the desired application. Moreover, though an institutional type of sliding door has been described, which includes aesthetically simple hardware, it should be understood that a more elaborate and/or aesthetically pleasing door and/or door hardware may be employed.

Figure 16:
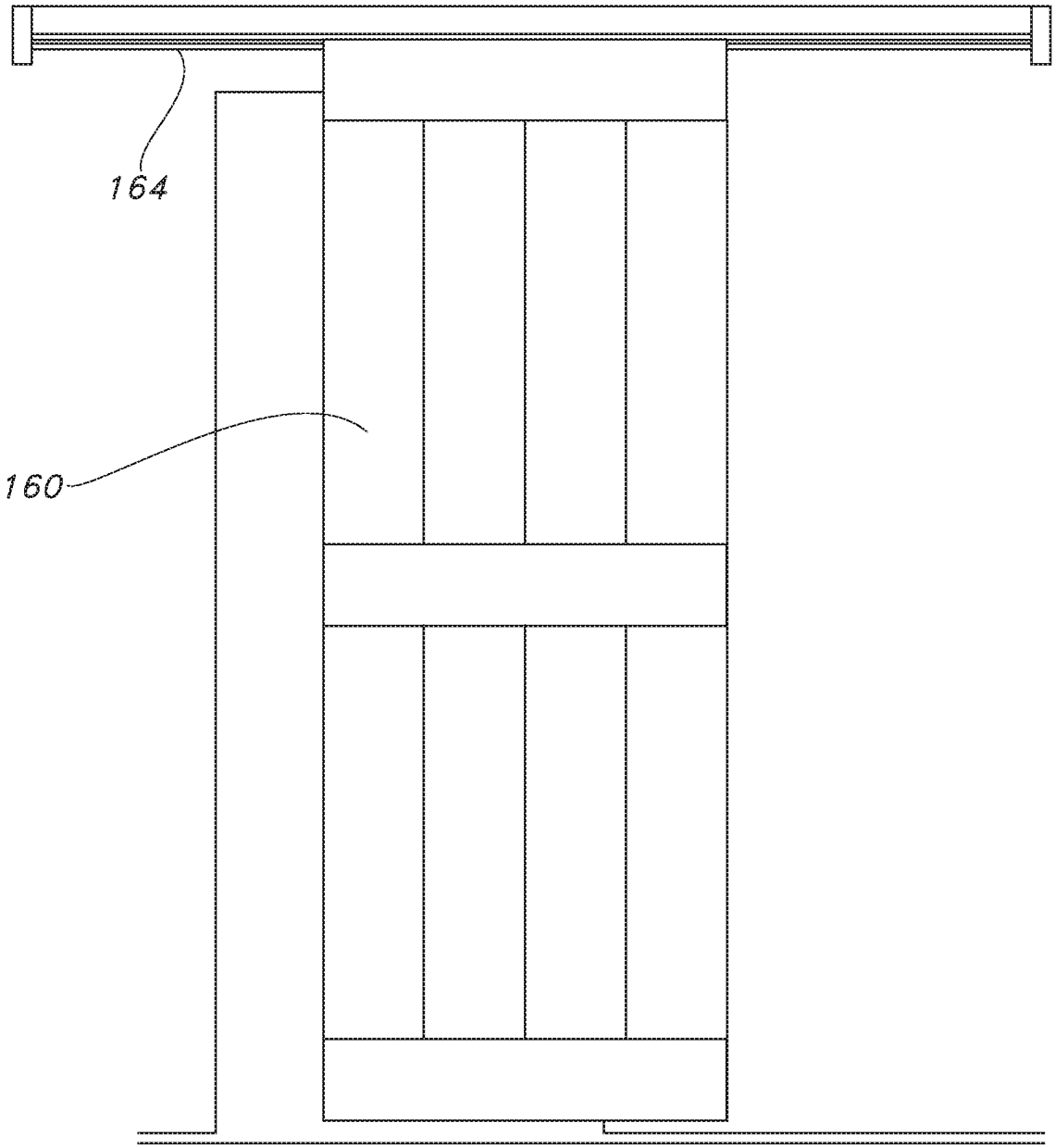
FIG. 16 is a barn style sliding door employing the basic sliding system of FIG. 8.

One such door, as shown in FIG. 16, is a barn style, surface-mounted sliding door (160). The track (164) may be configured in a more decorative fashion, particularly when it is intended that it be more exposed in application such as this (i.e., mounted to a ceiling or wall, rather than inside a frame). Various designs and finishes are also contemplated. All that is essential with respect to the track is that it be configured such that is includes a wider, protuberant portion (which may be generally rounded, although such is not strictly required) hanging downwardly from a mounting portion, and that the door have a sliding element at a top thereof with a channel sized and shaped to accommodate the track such that it is retained by and slidable thereon.

As previously described, the inventive system provides enhanced protection against the door becoming partially or fully disengaged from the mounting system, thereby providing enhanced reliability and a lower chance of accidental injury. The present invention also provides a sliding door having anti-ligature characteristics in that it is difficult for ligatures to be tied or looped around the door hardware, whether intentionally or unintentionally, to cause harm to persons having access thereto. The present invention further provides such a design that can be used in retrofit situations (e.g., where standard wall openings are provided), instead of requiring openings that have been particularly adapted for use with pocket-type sliding doors.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A sliding door system, comprising:

a door having a top surface;

a horizontally elongated member comprising:

a mounting portion with which the elongated member is mounted to a support structure; and a horizontally elongated track extending downwardly from the mounting portion;

wherein the horizontally elongated track comprises a horizontally elongated upper portion having a width, and a horizontally elongated protuberance below the upper portion having a width greater than the width of the upper portion;

at least one sliding element mounted to the top surface of the door, the sliding element having a channel corresponding to the protuberance and in which part of the elongated protuberance is disposed such that the sliding element is retained by and slidable on the protuberance;

wherein the door includes a front wall and a back wall opposite the front wall, and wherein the protuberance includes an aperture, the system further comprising:

a vertically extending rod positioned between the front and back walls of the door, the rod having a top end; and an actuator located on at least one of the front and back walls of the door for moving the rod between an unlocked position and a locked position, wherein, when the actuator moves the rod from the unlocked position to the locked position, the actuator moves the rod upwardly such that the top end of the rod is advanced into the aperture of the protuberance, and when the actuator moves the rod from the locked position to the unlocked position, the actuator moves the rod downwardly such that the top end of the rod is withdrawn from the aperture of the protuberance.

2. The sliding door system of claim 1, wherein the channel has a horizontally elongated opening along the top of the channel that accommodates the horizontally elongated upper portion of the track as the sliding element slides on the protuberance.

3. The sliding door system of claim 2, wherein the protuberance comprises a bulge, and the channel has a bulbous profile corresponding to the bulge.

4. The sliding door system of claim 1, further comprising an additional horizontally elongated member mounted to the top surface of the door, wherein the at least one sliding element mounted to the top surface of the door comprises a plurality of sliding elements affixed to the additional horizontally elongated member.

5. The sliding door system of claim 4, wherein the additional horizontally elongated member comprises an elongated metal plate disposed in a horizontal plane.

6. The sliding door system of claim 5, wherein the elongated metal plate has a plurality of through holes through which a plurality of screws are screwed into the top surface of the door.

7. The sliding door system of claim 1, wherein the channel is at least partially defined by a wall, the wall having at least one race with a plurality of ball bearings therein such that the ball bearings are rotated by the protuberance when the sliding element slides on the protuberance.

8. The sliding door system of claim 1, wherein the mounting portion comprises an elongated metal plate in a horizontal plane.

9. The sliding door system of claim 8, wherein the mounting portion further comprises:

a plurality of screws; and a plurality of through holes in the elongated metal plate through which the screws are screwed into the support structure.

10. The sliding door system of claim 1, wherein the actuator comprises a thumb-turn lock.

11. The sliding door system of claim 1, further comprising a floor guide adapted to be secured to a floor, wherein the door has a bottom surface with a guide channel therein corresponding to the floor guide and in which part of the floor guide is disposed such that the guide channel is slidable over the floor guide.

12. The sliding door system of claim 1, further comprising a shoe adapted to be secured to a floor, the shoe having a cavity that receives a lower corner of the door.

13. The sliding door system of claim 1, wherein the door has a vertically elongated end wall, the system further comprising a door stop mounted to the horizontally elongated track, the door stop having a metal wall disposed in a vertical plane that engages the vertically elongated end wall of the door.

14. The sliding door system of claim 1, further comprising a frame configured to be mounted to the surface of a wall around a door opening, the frame comprising a right vertical member, a left vertical member, and a horizontal member supported by the right and left vertical members, wherein the horizontal member comprises the support structure.

15. The sliding door system of claim 1, wherein the support structure comprises a horizontal beam configured to be mounted to the surface of a wall above a door opening.

16. The sliding door system of claim 1, wherein the support structure comprises a ceiling.

17. The sliding door system of claim 1, further comprising an end cap adjacent the sliding element, the end cap having a channel therein corresponding to the channel of the sliding element.

18. A sliding door system, comprising:

a door having a top surface;

a horizontally elongated member comprising:

a mounting portion with which the elongated member is mounted to a support structure; and a horizontally elongated track extending downwardly from the mounting portion;

wherein the horizontally elongated track comprises a horizontally elongated upper portion having a width, and a horizontally elongated protuberance below the upper portion having a width greater than the width of the upper portion; and at least one sliding element mounted to the top surface of the door, the sliding element having a channel corresponding to the protuberance and in which part of the elongated protuberance is disposed such that the sliding element is retained by and slidable on the protuberance;

wherein the door includes a front wall and a back wall opposite the front wall, further comprising an elongated metal plate affixed to at least one of the front and back walls of the door adjacent the top thereof such that the plate covers the at least one sliding element mounted to the top surface of the door.

19. The sliding door system of claim 18, further comprising a horizontally elongated skirt mounted above the mounting portion of the elongated member and overlapping at least part of the elongated metal plate.

20. A sliding door system, comprising:

a door having a top surface;

a horizontally elongated member comprising:

a mounting portion with which the elongated member is mounted to a support structure; and a horizontally elongated track extending downwardly from the mounting portion;

wherein the horizontally elongated track comprises a horizontally elongated upper portion having a width, and a horizontally elongated protuberance below the upper portion having a width greater than the width of the upper portion;

at least one sliding element mounted to the top surface of the door, the sliding element having a channel corresponding to the protuberance and in which part of the elongated protuberance is disposed such that the sliding element is retained by and slidable on the protuberance; and a frame configured to be mounted to the surface of a wall around a door opening, the frame comprising a right vertical member, a left vertical member, and a horizontal member supported by the right and left vertical members, wherein the horizontal member comprises the support structure;

wherein the door includes a back wall, further comprising an elongated metal plate have a width and affixed to back wall of the door adjacent the top thereof such that the plate covers the at least one sliding element mounted to the top surface of the door, and wherein, when the frame is mounted to the wall around the door opening, the distance between the back wall of the door and the wall around the door opening is approximately equal to the width of the plate.

21. The sliding door system of claim 20, wherein the distance is approximately ⅛ of an inch.

* * * * *